US010791775B2

(12) United States Patent
Grogro et al.

(10) Patent No.: US 10,791,775 B2
(45) Date of Patent: Oct. 6, 2020

(54) APPAREL ITEM FOR UPRIGHT SLEEPING

(71) Applicant: NIKE, Inc., Beaverton, OR (US)

(72) Inventors: Daniela Grogro, Portland, OR (US); Ryan P. Henry, Beaverton, OR (US); Daniel A. Judelson, Portland, OR (US); Iustinia Koshkaroff, Portland, OR (US); Mark McNamee, Portland, OR (US); Christopher J. Ranalli, Portland, OR (US); Kevin C. Sze, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 235 days.

(21) Appl. No.: 16/071,668

(22) PCT Filed: Jan. 20, 2017

(86) PCT No.: PCT/US2017/014246
§ 371 (c)(1),
(2) Date: Jul. 20, 2018

(87) PCT Pub. No.: WO2017/127621
PCT Pub. Date: Jul. 27, 2017

(65) Prior Publication Data

US 2019/0059462 A1 Feb. 28, 2019

Related U.S. Application Data

(60) Provisional application No. 62/281,850, filed on Jan. 22, 2016.

(51) Int. Cl.
*A41D 1/04* (2006.01)
*A41D 27/00* (2006.01)
(Continued)

(52) U.S. Cl.
CPC ..... *A41D 1/04* (2013.01); *A41D 3/00* (2013.01); *A41D 13/0002* (2013.01);
(Continued)

(58) Field of Classification Search
CPC ..... A41D 1/04; A41D 3/00; A41D 13/0002; A41D 13/0007; A41D 27/00; A41D 31/02
(Continued)

(56) References Cited

U.S. PATENT DOCUMENTS 2,156,478 A * 5/1939 Kemp ..... A41F 1/006 450/85
2,521,373 A * 9/1950 Hutchison ..... A41C 3/00 450/77
(Continued)

FOREIGN PATENT DOCUMENTS

CN 85204595 U 8/1986
EP 2025254 A1 2/2009
(Continued)

OTHER PUBLICATIONS

Costa, Christen, "Burton Sleeper Hoodie now Includes a Pillow, Hidden Passport Pocket and Toothbrush," Gadget Review, gadgetreview.com, accessed: Oct. 2015. http://www.gadgetreview.com/burtonsleeperhoodie.
(Continued)

*Primary Examiner* — Gloria M Hale
(74) *Attorney, Agent, or Firm* — Shook, Hardy and Bacon LLP

(57) ABSTRACT

Aspects herein provide for an apparel item (100) for upright sleeping. The apparel item (100) comprises features to reduce distractions such as a hood (124) with an integrated eye mask (310) and foam inserts (314) integrated into the hood (124) and configured to be positioned over the wearer's ears when the hood (124) is worn. The apparel item
(Continued)

(100) further comprises a strap system (400) that is configured to hold the wearer's head in a static position during upright sleeping.

27 Claims, 13 Drawing Sheets

(51) Int. Cl.

| | |
|---|---|
| ***A41D 13/00*** | (2006.01) |
| ***A41D 3/00*** | (2006.01) |
| ***A41D 31/02*** | (2019.01) |
| *A41D 10/00* | (2006.01) |
| *A41D 27/20* | (2006.01) |

(52) U.S. Cl.
CPC ..... *A41D 13/0007* (2013.01); *A41D 27/00* (2013.01); *A41D 31/02* (2013.01); *A41D 10/00* (2013.01); *A41D 27/20* (2013.01); *A41D 2200/20* (2013.01); *A41D 2300/322* (2013.01); *A41D 2600/00* (2013.01)

(58) Field of Classification Search
USPC ..... 2/84, 69, 69.5
See application file for complete search history.

(56) References Cited

U.S. PATENT DOCUMENTS

| | | | | |
|---|---|---|---|---|
| 3,676,879 | A | 7/1972 | Irie | |
| 3,933,865 | A * | 1/1976 | Schwarz | C07D 303/36 549/553 |
| 4,300,568 | A * | 11/1981 | Blanckmeister | A41F 1/006 450/85 |
| 4,560,201 | A | 12/1985 | Scott | |
| 5,339,466 | A | 8/1994 | McMullen | |
| 5,815,833 | A | 10/1998 | Kuo | |
| 6,397,395 | B1 | 6/2002 | DeHart | |
| 6,425,138 | B1 | 7/2002 | Johnson | |
| 6,651,256 | B1 | 11/2003 | Swift | |
| 7,657,954 | B1 | 2/2010 | Bunkers | |
| D641,136 | S | 7/2011 | Abrams et al. | |
| 8,239,987 | B2 | 8/2012 | Sharp | |
| 8,990,980 | B1 | 3/2015 | Hindley | |
| 2012/0129426 | A1 * | 5/2012 | Tyrer | A41C 3/0021 450/31 |
| 2013/0125312 | A1 | 5/2013 | Harooni | |
| 2013/0152270 | A1 | 6/2013 | Neal et al. | |
| 2014/0259423 | A1 | 9/2014 | Falck | |
| 2015/0042143 | A1 | 2/2015 | Maginness et al. | |
| 2015/0250240 | A1 | 9/2015 | Hunkele | |
| 2018/0325186 | A1 * | 11/2018 | Yamamoto | A41C 3/0057 |

FOREIGN PATENT DOCUMENTS

| | | | |
|---|---|---|---|
| GB | 2492588 | A | 1/2013 |
| WO | 2011047417 | A1 | 4/2011 |
| WO | 2014182733 | A1 | 11/2014 |
| WO | 2015022446 | A1 | 2/2015 |

OTHER PUBLICATIONS

Liszewski, Andrew, "The Best Travel Companion Since Sleeping Pills" Gizmodo, gizmodo.com, May 7, 2013. http://gizmodo.com/thebesttravelcompanionsincesleepingpills493786586.

Noe, Rain, "Baubax's Travel Jacket," Kickstarter.com, Jul. 7, 2015 https://www.kickstarter.com/projects/597538543/theworldsbesttraveljacketwith15featuresbau/.

Master Blaster, "Like to Sleep on Public Transportation? Protect Ya Neck with the UpRight Sleeper," Rocket News 24, en.rocketnews24.com, Oct. 19, 2012. http://en.rocketnews24.com/2012/10/19/liketosleeponpublictransportationprotectyaneckwiththeuprightsleeper/.

Wittmann, Simone, "Napper by Simone WittmannSleep in Public Transport More Comfortable and Secured," Design Rulz, designrulz.com, Jun. 9, 2013 https://web.archive.org/web/20130609231138/http://www.designrulz.com/design/2013/06/napperbysimonewittmannsleepinpublictransportmorecomfortableandsecured.

Communication under Rule 71(3) dated May 16, 2019 in European Patent Application No. 17703549.0, 5 pages.

Extended European Search Report received for European Patent Application No. 19213515, dated Mar. 10, 2020, 5 pages.

* cited by examiner

APPAREL ITEM FOR UPRIGHT SLEEPING

CROSS-REFERENCE TO RELATED APPLICATIONS

This application, assigned U.S. application Ser. No. 16/071,668, filed Jul. 20, 2018, and entitled "Apparel Item for Upright Sleeping," is a 35 U.S.C. § 371 national stage application of PCT Application Number PCT/US2017/014246, filed on Jan. 20, 2017, and entitled "Apparel Item for Upright Sleeping," which claims the benefit of priority of U.S. Provisional Application No. 62/281,850, filed on Jan. 22, 2016, and entitled "Apparel Item for Upright Sleeping." The entireties of the aforementioned applications are incorporated by reference herein.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The present invention is defined by the claims.

At a high level, aspects herein are directed to an apparel item configured to reduce distractions and/or to promote upright sleeping. People that travel frequently, via, for instance, bus, car, plane, or train, desire or need to sleep while en route to their destination. However, it is often difficult to sleep in an upright position due to head bobbing, uncomfortable head and neck positions, and the like. Moreover, distractions that commonly occur while traveling such as loud voices, cold temperatures, crying children, and bright lights may also make sleeping, or even concentrating, difficult. The apparel item described herein is configured to reduce distractions and is further configured to hold the wearer's head in a static position, thereby facilitating upright sleeping.

In exemplary aspects, the apparel item described herein is in the form of a jacket, where the jacket comprises a number of features designed to reduce distractions and promote wearer comfort. For instance, to help eliminate or reduce distractions such as noise and light, the apparel item may comprise a hood with an integrated eye mask portion that can be easily drawn over the wearer's eyes to reduce or eliminate unwanted light. To aid in this, the eye mask portion may be formed from a blackout fabric (e.g., an opaque fabric that may have an optional foam backer that is used to block light). Further, the inferior or lower edge of the eye mask portion may comprise a moldable strip such that the eye mask can be molded around the wearer's nose and under the wearer's eyes to provide a more customized fit and to prevent light rays from reaching the wearer's eyes.

To help eliminate or reduce noise, the hood may comprise foam inserts such as closed-cell acoustic foam or neoprene foam that are positioned between inner and outer layers of the hood so that they overlay the ears of the wearer when the hood is in an as-worn position. The foam inserts may also help cushion the wearer's ears when the wearer leans her head against a hard object such as frequently occurs during travel. Further, the right and left side margins of the hood may comprise adjustable tightening mechanisms such as drawstrings so that the hood can be made to more closely conform to the wearer's head and the foam inserts to more closely conform to the wearer's ears.

To promote wearer comfort, the apparel item described herein may be formed of a knit or woven material with a soft hand. Additionally, the apparel item may comprise a strap system that is configured to hold the wearer's head in a static position and thus help to eliminate head bobbing and uncomfortable head and neck positions that often result when attempting to sleep in an upright position. In aspects, the strap system comprises a first strap segment having a first end located at a right side area of the hood, a second end anchored to a left front side of the body of the apparel item, and an intervening portion that extends from the first end, traverses the posterior aspect of the body of the apparel item from the right side to the left side, and terminates at the second end. The strap system further comprises a second strap segment having a first end located at a left side area of the hood, a second end anchored to a right front side of the body of the apparel item, and an intervening portion that extends from the first end, traverses the posterior aspect of the body of the apparel item from the left side to the right side, and terminates at the second end. Each of the first and second strap segments comprises an adjustable tightening mechanism located near or at the second ends of the respective strap segments. Continuing, the strap system additionally comprises a third strap segment that couples the first end of the first strap segment to the first end of the second strap segment. When the hood is in an up position, the third strap segment is configured to overlie an upper forehead area of the wearer.

The apparel item is configured such that most of the strap system is hidden from view thereby creating a better visual aesthetic than if the strap system was exposed. For instance, the jacket along with the hood may be formed from an inner layer and an outer layer of material. The third strap segment may be located between the inner and outer layers of the hood thus hiding this portion from view. Moreover, the first ends of the first and second strap segments along with the majority of the intervening portions of the first and second strap segments may be located between the inner and outer layers of the hood and the jacket thus hiding these portions from view. The second ends of the first and second straps segments along with their adjustable tightening mechanisms, although still located between the inner and outer layers of the jacket, may be accessible to the wearer via, for instance, pockets. For instance, the second ends along with their adjustable tightening mechanisms may be located in an interior aspect of right and left side pockets located on the front of the jacket.

To use the strap system, the wearer would don the jacket and use a zipper assembly to secure the front panels of the jacket. Once donned, the wearer would position the hood over the wearer's head such that the third strap segment generally overlies the upper forehead area of the wearer. The wearer can then apply tension to the strap system by using the adjustable tightening mechanisms associated with the second ends of the first and second strap segments. More particularly, the wearer can access the adjustable tightening mechanism by inserting his hand into the right and/or left pocket. The tension applied using the adjustable tightening mechanism is distributed along the first strap segment and the second strap segment to the third strap segment. Since this segment is positioned around the wearer's forehead area, the tension helps to pull the wearer's head to an upright position and to maintain this position until the tension is released.

BRIEF DESCRIPTION OF THE DRAWING

Examples of the present invention are described below with reference to the attached drawings figures, wherein.

DETAILED DESCRIPTION OF THE INVENTION

The subject matter of the present invention is described with specificity herein to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

Aspects herein relate to an apparel item for an upper torso of a wearer, where the apparel item is configured to reduce distractions and/or to facilitate upright sleeping. In exemplary aspects the apparel item, when in the form of a jacket, may comprise a hood portion with an integrated eye mask that may be used to prevent unwanted light from reaching the eyes of the wearer. To aid in this, when in an as-worn configuration, the inferior or lower edge of the eye mask comprises a moldable bill that can be used to mold the inferior edge of the eye mask over the wearer's nose and undereye areas. The hood portion may further comprise foam inserts that are positioned in the hood such that they overlay the ears of the wearer when the hood portion is worn. The foam inserts help to prevent unwanted noise from reaching the ears of the wearer and may also function to cushion the ear area of the wearer. As well, the apparel item comprises a strap system that may be used to help hold the wearer's head in a static position to facilitate upright sleeping as explained in greater depth below. The features described above may be used by themselves or in combination to provide varying levels of distraction reduction.

Figure 1:
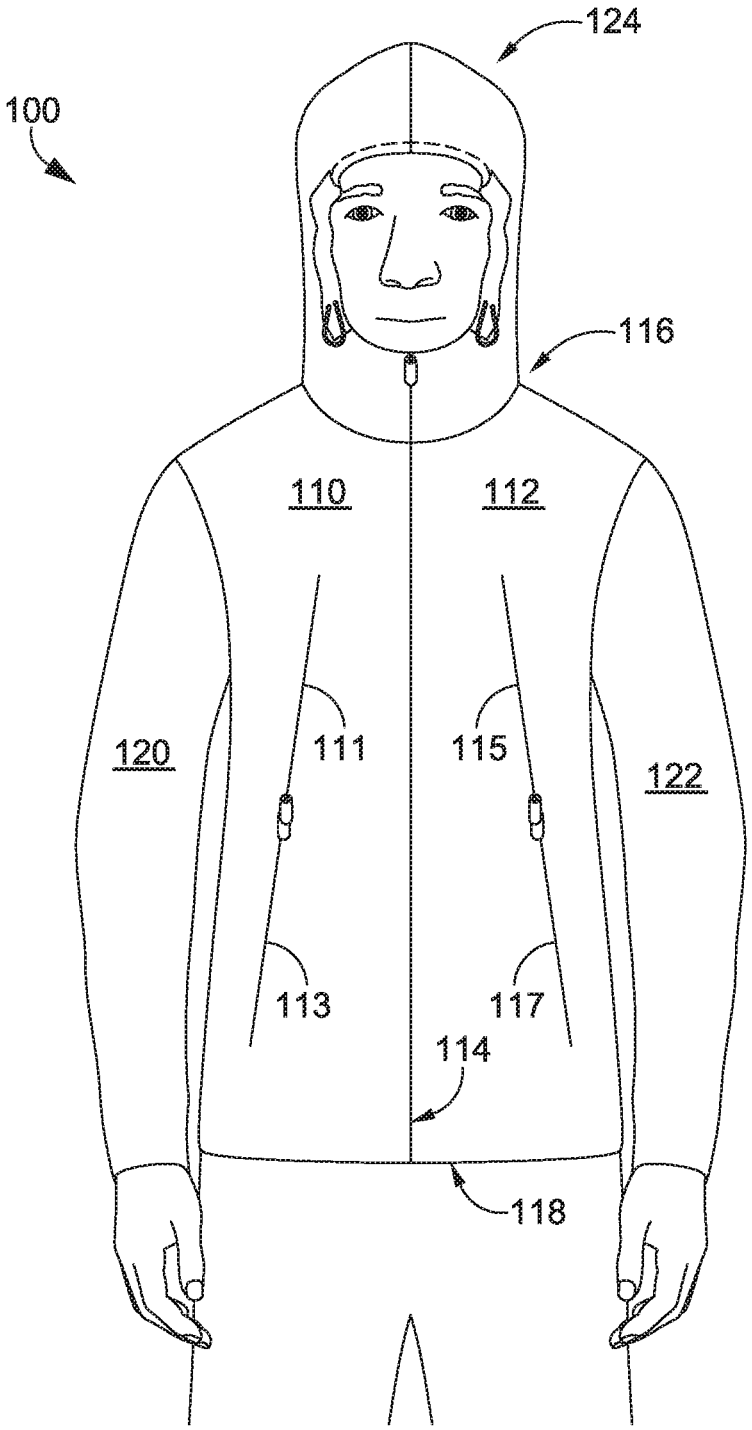
FIG. 1 illustrates a front view of an exemplary apparel item configured to reduce distractions and promote upright sleeping in accordance with aspects herein.
Figure 2:
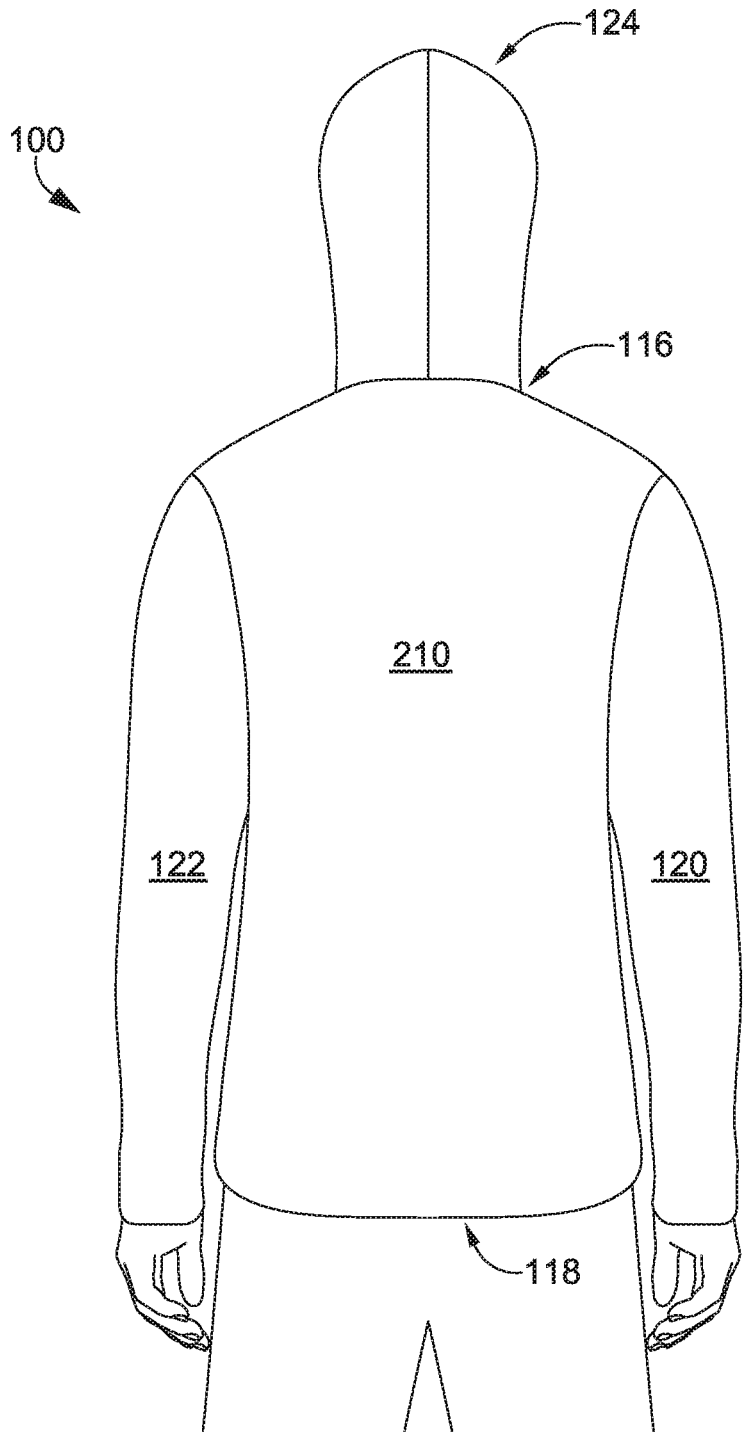
FIG. 2 illustrates a back view of the exemplary apparel item of FIG. 1 in accordance with aspects herein.

Turning now to FIGS. 1 and 2, FIG. 1 depicts a front view of an exemplary apparel item 100 configured to reduce distractions and promote upright sleeping, and FIG. 2 depicts a back view of the apparel item 100 in accordance with aspects herein. The apparel item 100 is shown in an as-worn configuration and is in the form of an apparel item for an upper torso of a wearer. More specifically, the apparel item 100 is in the form of a jacket/coat with a hood. However, it is contemplated herein that the apparel item 100 may take other forms such as a hoodie, a sleeveless jacket, a jacket with partial sleeves, a hoodie with partial sleeves or no sleeves, and the like.

As used throughout this disclosure, the term "as-worn configuration" or "worn" means the apparel item 100 as worn by a wearer standing in anatomical position as that term is known in the art. Further, terms such as "anterior," "posterior," "lateral," "medial," "superior," "inferior," and "mid-axillary" are meant to be given their common anatomical meanings and are used with respect to the apparel item 100 being in the as-worn configuration. When used in this disclosure, the term "affixing," "coupling," or "securing" may comprise releasably affixing two items together via, for instance, buttons, snaps, zippers, hook-and-loop fasteners, and the like, and may also comprise permanently affixing two items together via, for example, stitching, bonding, adhesives, welding, and the like. Any and all aspects, and any variation thereof, are contemplated as being within the scope herein.

In exemplary aspects, the apparel item 100 may comprise at least a first front panel 110 and a second front panel 112 that are releasably affixed together via, for instance, a zipper assembly 114. Although a zipper assembly 114 is described, it is contemplated herein that other means of releasably affixing the first and second front panels 110 and 112 together such as hook-and-loop fasteners, snaps, buttons, and the like may be used. In exemplary aspects, the first front panel 110 may comprise a first right side pocket 111 and an optional second right side pocket 113, and the second front panel 112 may comprise a first left side pocket 115 and an optional second left side pocket 117. In exemplary aspects, the first and second right side pockets 111 and 113 and the first and second left side pockets 115 and 117 may comprise releasable closure mechanisms such as a zipper-type mechanism, buttons, snaps, hook-and-loop fasteners, and the like to maintain the pockets 111, 113, 115, and 117 in a closed state when not being accessed. Although only four pockets are shown, it is contemplated herein that the apparel item 100 may comprise additional pockets positioned at different locations on the apparel item 100.

The apparel item 100 further comprises a back panel 210 that together with at least the first and second front panels 110 and 112 define at least a neckline opening 116, a waist opening 118, and right and left sleeve openings to which optional sleeves 120 and 122 may be affixed. The apparel item 100 further comprises a hood 124 that is affixed at least in part to the neckline opening 116. As shown in FIGS. 1 and 2, the hood 124 is in an upright or as-worn position such that is overlays a head area of the wearer. As used throughout this disclosure, the term "front panel(s)" means a panel(s) that is adapted to cover a front area of a wearer when the apparel item 100 is worn, and the term "back panel" means a panel that is adapted to cover a back area of a wearer when the apparel item 100 is worn. The front panel(s) and the back panel may, in exemplary aspects, comprise two or more separate panels affixed together at one or more seams, or, alternatively, the front panel(s) and the back panel may comprise a unitary panel. Moreover, it is contemplated herein that additional sub-panels may be used to form the apparel item 100. Any and all aspects, and any variation thereof, are contemplated as being within the scope herein.

Some or all of the first and second front panels 110 and 112, the back panel 210, the sleeves 120 and 122, and the hood 124 may be formed from a knit or woven material having a soft hand so as to promote wearer comfort. Further, the materials used to form the different portions of the apparel item 100 may be selected to provide greater or lesser degrees of warmth when the apparel item 100 is worn.

Figure 7A:
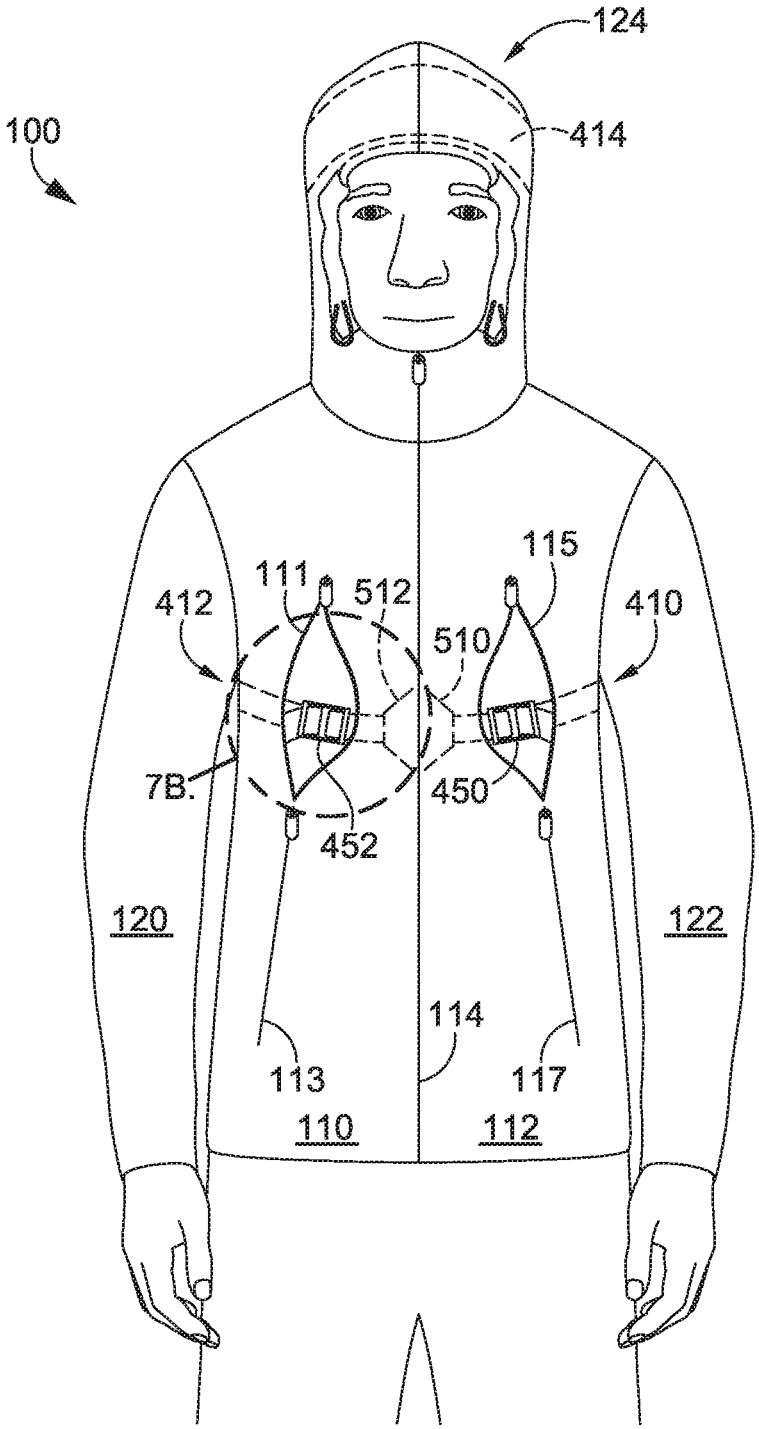
FIG. 7A illustrates an interior view of a pocket of the exemplary apparel item of FIG. 1 in accordance with aspects herein.
Figure 7B:
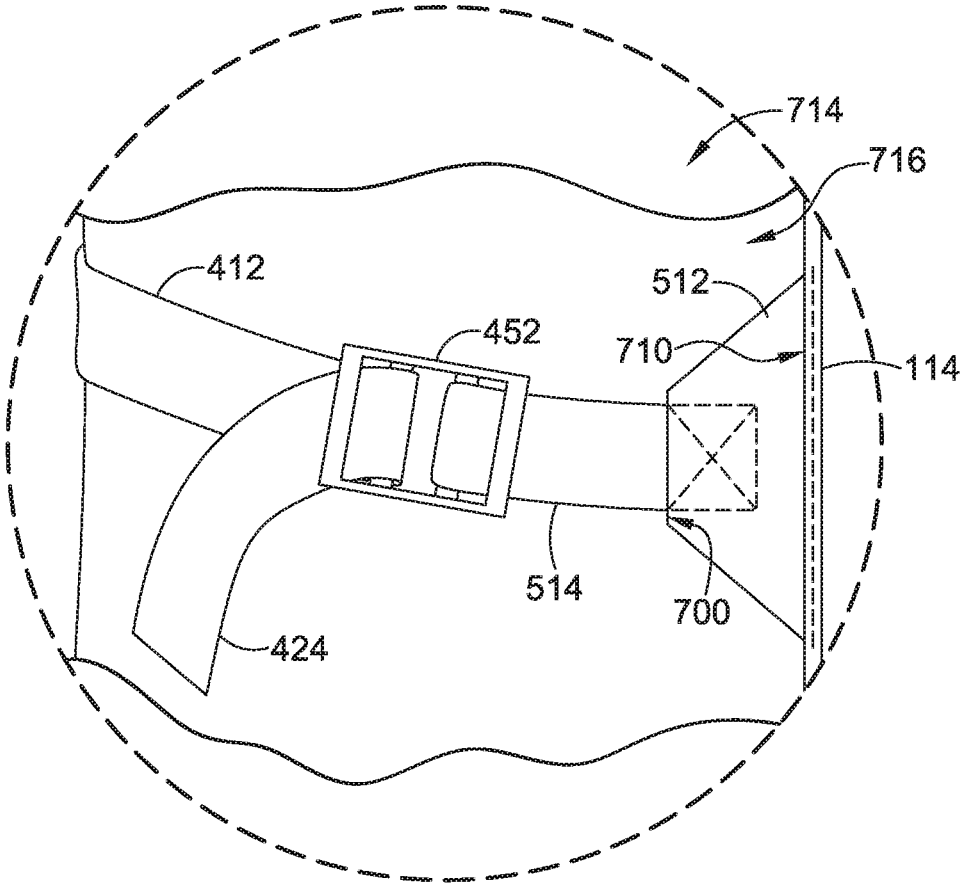
FIG. 7B illustrates a close-up, cut-away view of the pocket of FIG. 7A in accordance with aspects herein.

In exemplary aspects, at least the first and second front panels 110 and 112, the back panel 210, and the hood 124 may comprise at least a two-layer construction having an outer layer and an inner layer that define a space or void between the two layers (shown in, for example, FIG. 7B). In other words, the outer layer and the inner layer may be unaffixed from one another except at select locations so that the space or void exists between the two layers over the majority of the first and second front panels 110 and 112, the back panel 210, and the hood 124. In exemplary aspects, at least the first right side pocket 111 and the first left side pocket 115 open into this space or void between the outer layer and the inner layer (i.e., the pockets 111 and 115 do not comprise a separate liner). In other words, the interior volume of the pockets 111 and 115 comprises the space or void between the two layers. As will be explained in greater depth below, this two-layer construction is useful for hiding the strap system of the apparel item 100 in order to provide greater wearer comfort and to create a better visual aesthetic. Continuing, the outer layer and the inner layer may be formed of the same material in some exemplary aspects. But it is also contemplated herein that the outer layer and the inner layer may be formed of different materials to achieve different functional benefits (e.g., a softer inner layer and a more durable outer layer). Any and all aspects, and any variation thereof, are contemplated as being with the scope herein.

Figure 3:
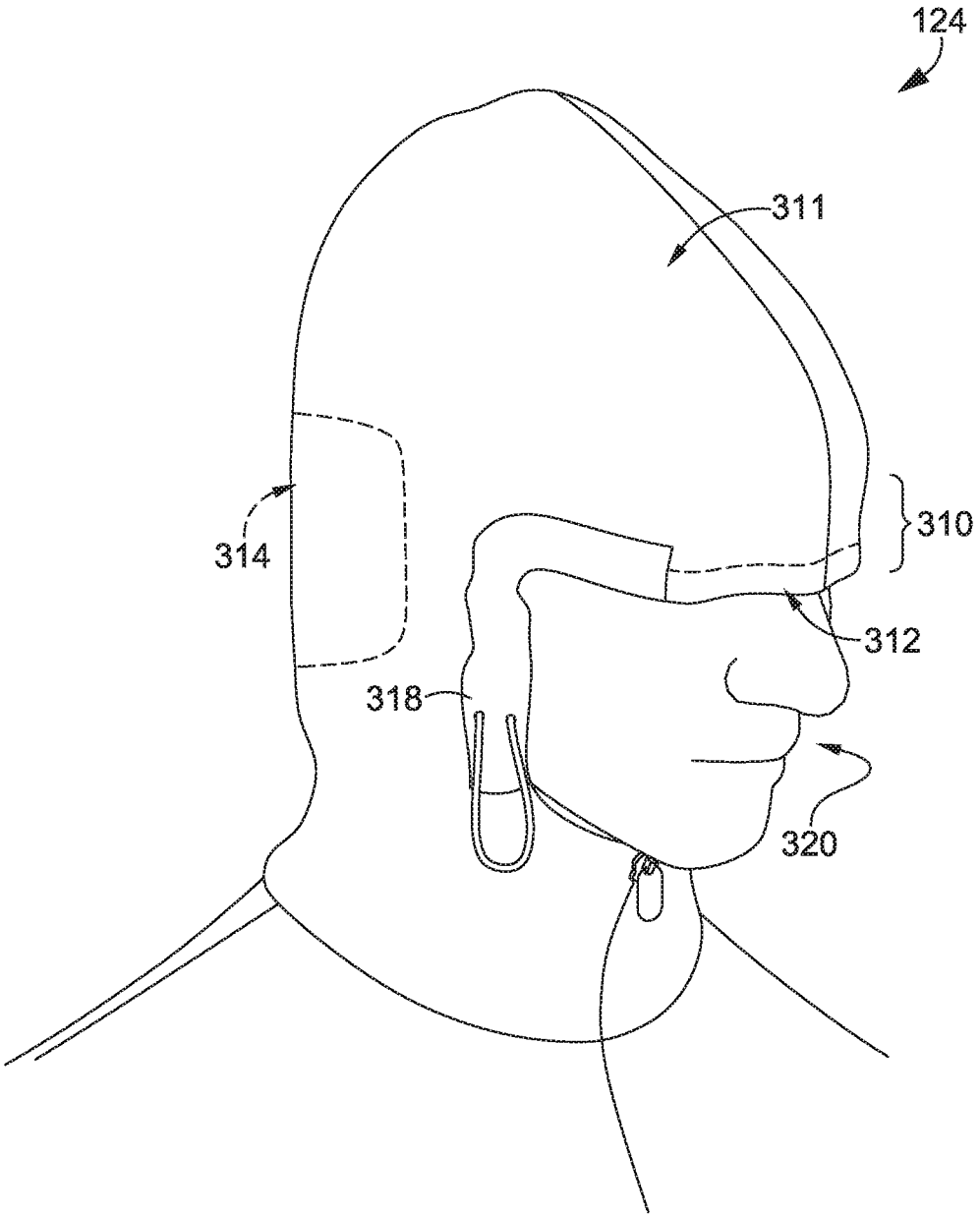
FIG. 3 illustrates a close-up view of a hood of the exemplary apparel item of FIG. 1 in accordance with aspects herein.

With respect to some of the features of the apparel item 100 that reduce distractions and facilitate upright sleeping, FIG. 3 depicts a close-up view of the hood 124 in accordance with aspects herein. In exemplary aspects, the hood 124 comprises an integrated eye mask 310 that can be used to block ambient light. For example, a wearer may pull the eye mask 310 over the wearer's eyes as shown in FIG. 3 in order to block ambient light. The eye mask 310 comprises an integral extension of a superior portion 311 of the hood 124. For instance, the front two to four inches of the superior portion 311 of the hood 124 may function as the eye mask 310. In exemplary aspects, at least the eye mask 310 of the hood 124 may be formed from blackout fabric (i.e., an opaque fabric and/or a foam-backed opaque fabric used to block light rays). Further, a front or leading edge of the eye mask 310 may comprise a moldable strip 312 that is positioned between the outer layer and the inner layer of the hood 124. The moldable strip 312 may be used to provide a more customized fit for the eye mask 310. For instance, the moldable strip 312 may be molded around the nose and undereye areas of the wearer to further help block unwanted ambient light as shown in FIG. 3. In exemplary aspects, the moldable strip 312 may be formed from a plastic material, a rubber material, a polyurethane material, a metal material, and the like.

The hood 124 may further comprise a right foam insert 314 and a left foam insert (not seen in FIG. 3) where the right foam insert 314 is indicated by dotted lines in FIG. 3 to show that it is hidden from view. The foam inserts 314 are located at a right side portion of the hood 124 and at a left side portion of the hood 124. The foam inserts 314 are positioned between the outer layer and the inner layer of the hood 124. In use, the foam inserts 314 would be positioned over the wearer's ears where they may help to reduce ambient noise and/or provide a cushion layer useful when the wearer lays his head against a hard object or surface.

In exemplary aspects, the foam inserts 314 may be formed from a closed-cell acoustic foam material, neoprene, or other types of foam materials. Each of the foam inserts 314 may have a generally rectangular shape having dimensions comprising, for instance, 2 in.×3 in., 3 in.×4 in., and/or values in between these dimensions, where the long axis of the inserts 314 is positioned in a generally inferior to superior direction when the hood 124 is in an upright position and as shown in FIG. 3. It is contemplated herein that the foam inserts 314 may have other shapes such as squares, circles, ovals, and the like. Any and all aspects, and any variation thereof, are contemplated as being within the scope herein.

FIG. 3 further depicts adjustable tightening mechanisms 318 and 320 located at the right and left side margins of the hood 124 respectively (also seen in FIG. 1). The adjustable tightening mechanisms 318 and 320 may be used to further snug the hood 124 around the face area of the wearer. This, in turn, may further help to block unwanted light rays from reaching the eyes of the wearer and may also help to further secure the foam inserts 314 against the ears of the wearer. The adjustable tightening mechanisms 318 and 320 may comprise cord locks known in the art.

Figure 4A:
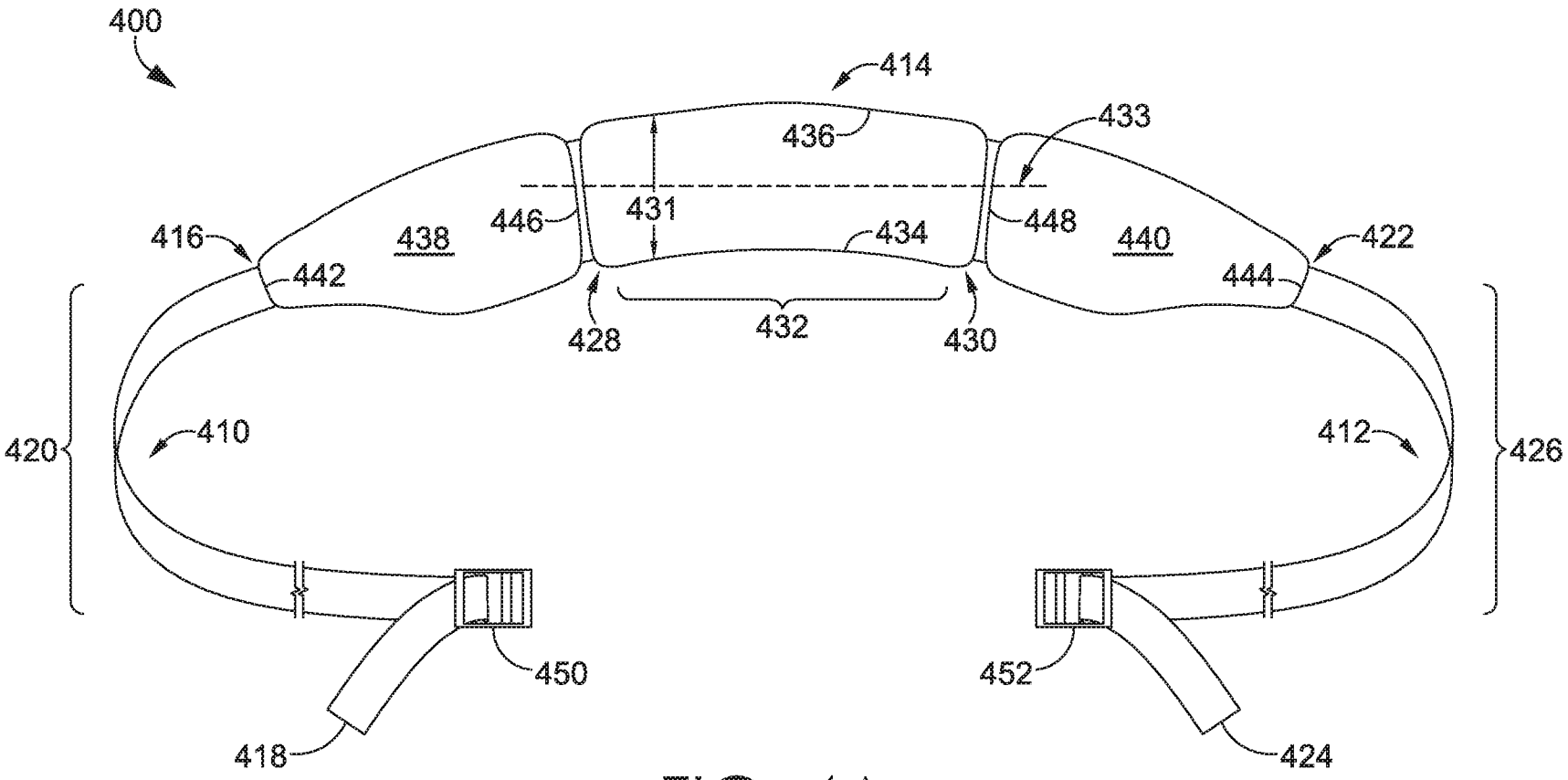
FIG. 4A illustrates an exemplary strap system used to promote upright sleeping in accordance with aspects herein.
Figure 4B:
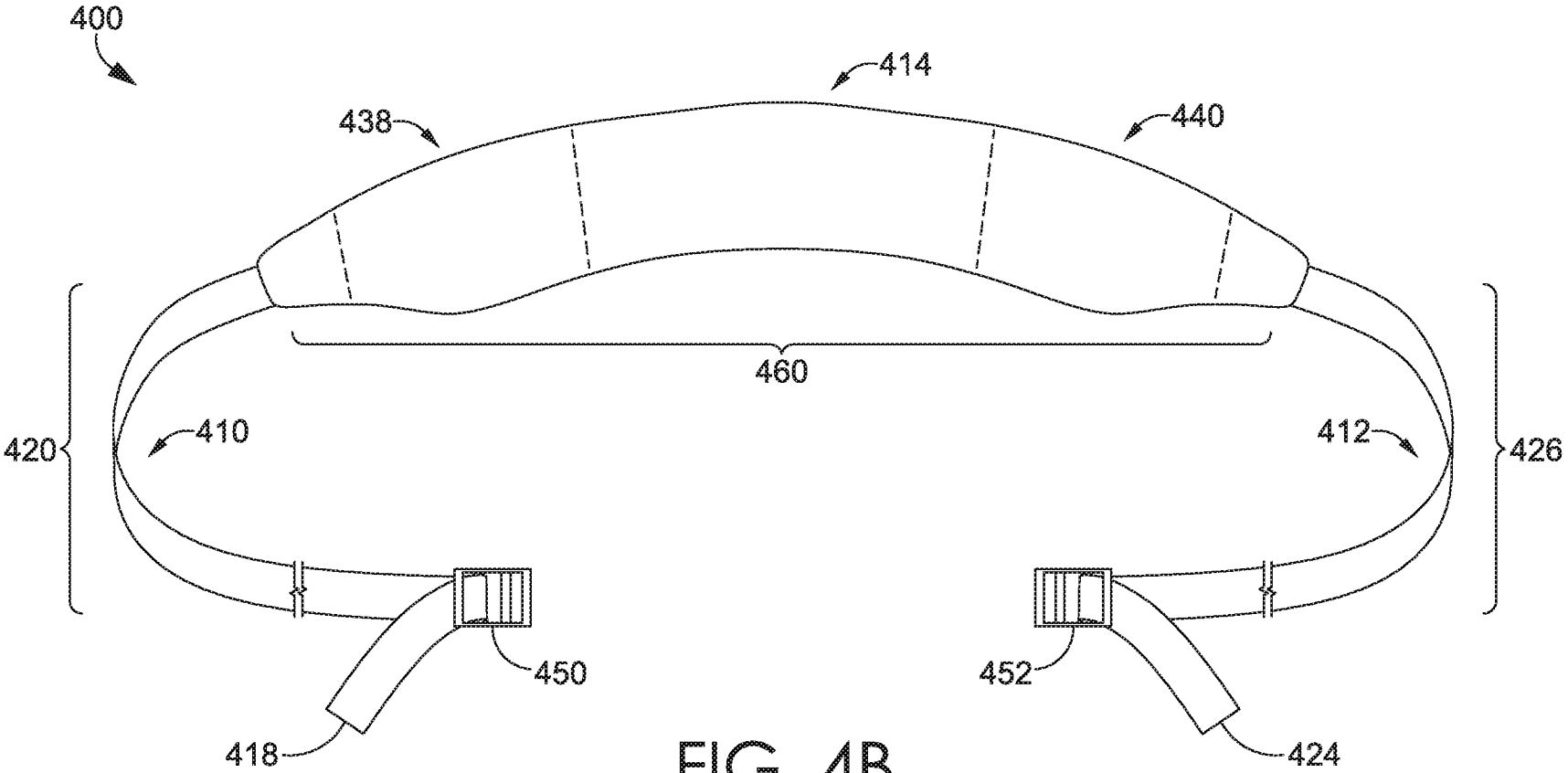
FIG. 4B illustrates an alternative configuration of the exemplary strap system of FIG. 4A in accordance with aspects herein.

The apparel item 100 further comprises a strap system. A depiction of the strap system in isolation (removed from the apparel item 100) is shown in FIGS. 4A and 4B in accordance with aspects herein. With respect to FIG. 4A, a first exemplary strap system 400 is shown. The strap system 400 comprises a first strap segment 410, a second strap segment 412, and a third strap segment 414. In exemplary aspects, the first strap segment 410 and the second strap segment 412 may be formed of webbing such as 1 in. webbing, 1.5 in. webbing, or 2 in. webbing, although dimensions above and below these are contemplated as being within the scope herein. The length of the first and second strap segments 410 and 412 may be variable depending on the size dimensions of the apparel item in which the strap system 400 is to be incorporated (e.g., shorter length for apparel items configured for children and women and longer length for apparel items configured for men). In general, the length of the first and second strap segments 410 and 412 is such that each strap segment 410 and 412 has a length sufficient to extend generally from the hood 124 of the apparel item 100, diagonally across the back panel 210 of the apparel item 100, and terminate at the first and second front panels 110 and 112 of the apparel item 100 at a location approximately midway between the neckline opening 116 and the waist opening 118.

In exemplary aspects, the first strap segment 410 comprises a first end 416, a second end 418, and an intervening portion 420. Similarly, the second strap segment 412 comprises a first end 422, a second end 424, and an intervening portion 426. The third strap segment 414 comprises a first end 428, a second end 430, and an intervening portion 432. In exemplary aspects, the third strap segment 414 has a greater width 431 than the first and second strap segments 410 and 412. For instance, the third strap segment 414 may have a width 431 of 2 in., 3 in., 4 in., or widths between these values. Moreover, the third strap segment 414 may have a slightly curved shape such that a first edge 434 is concave with respect to a hypothetical axis 433 bisecting the third strap segment 414 into a posterior portion and an anterior portion (with reference to the strap system 400 in an as-used configuration), and a second edge 436 is convex with respect to the hypothetical axis 433. The width and shape of the third strap segment 414 are selected so as to help contour the third strap segment 414 to the general shape of an upper forehead area of a wearer when the strap system 400 is used. Moreover, by using a greater width 431, tension applied to the third strap segment 414 via the first and second strap segments 410 and 412 may be more evenly distributed over the forehead area of the wearer resulting in greater comfort to the wearer.

In exemplary aspects, the first end 416 of the first strap segment 410 is coupled to the first end 428 of the third strap segment 414 by way of, for instance, a foam insert 438 such as the foam insert 314 discussed above. As well, the first end 422 of the second strap segment 412 is coupled to the second end 430 of the third strap segment 414 by way of, for instance, a foam insert 440 such as the foam insert 314 discussed above. More specifically and with reference to the strap system 400 in an as-used configuration, the first end 416 of the first strap segment 410 may be permanently affixed to an inferior edge 442 of the foam insert 438, and the first end 422 of the second strap segment 412 may be permanently affixed to an inferior edge 444 of the foam insert 440. Continuing, in exemplary aspects, the first end 428 of the third strap segment 414 is permanently affixed to a superior edge 446 of the foam insert 438, and the second end 430 of the third strap segment 414 is permanently affixed to a superior edge 448 of the foam insert 440.

The second ends 418 and 424 of the first and second strap segment 410 and 412 may comprise adjustable tightening mechanisms 450 and 452 respectively. In exemplary aspects, the adjustable tightening mechanisms 450 and 452 may comprise a friction buckle although other types of buckles are contemplated herein such as tri-glides, ladder locks, cinch locks, and the like.

FIG. 4B depicts an alternative aspect for the strap system 400. In this aspect, a sheath or covering 460 is used to cover, for instance, the third strap segment 414, and the first and second foam inserts 438 and 440. The covering 460 may also be used to cover the junction point between the first end 416 of the first strap segment 410 and the inferior edge 442 of the first foam insert 438 as well as the junction point between the first end 422 of the second strap segment 412 and the inferior edge 444 of the second foam insert 440. In exemplary aspects, the covering 460 may comprise a fabric panel. The use of the covering 460 may, for example, allow for easier manipulation of the strap system 400 during manufacture of the apparel item 100 and/or greater wearer comfort. The depiction of the covering 460 in FIG. 4B is exemplary only and it is contemplated herein that the covering 460 may cover more or less of the different portions of the strap system 400 than those shown in FIG. 4B.

Figure 5:
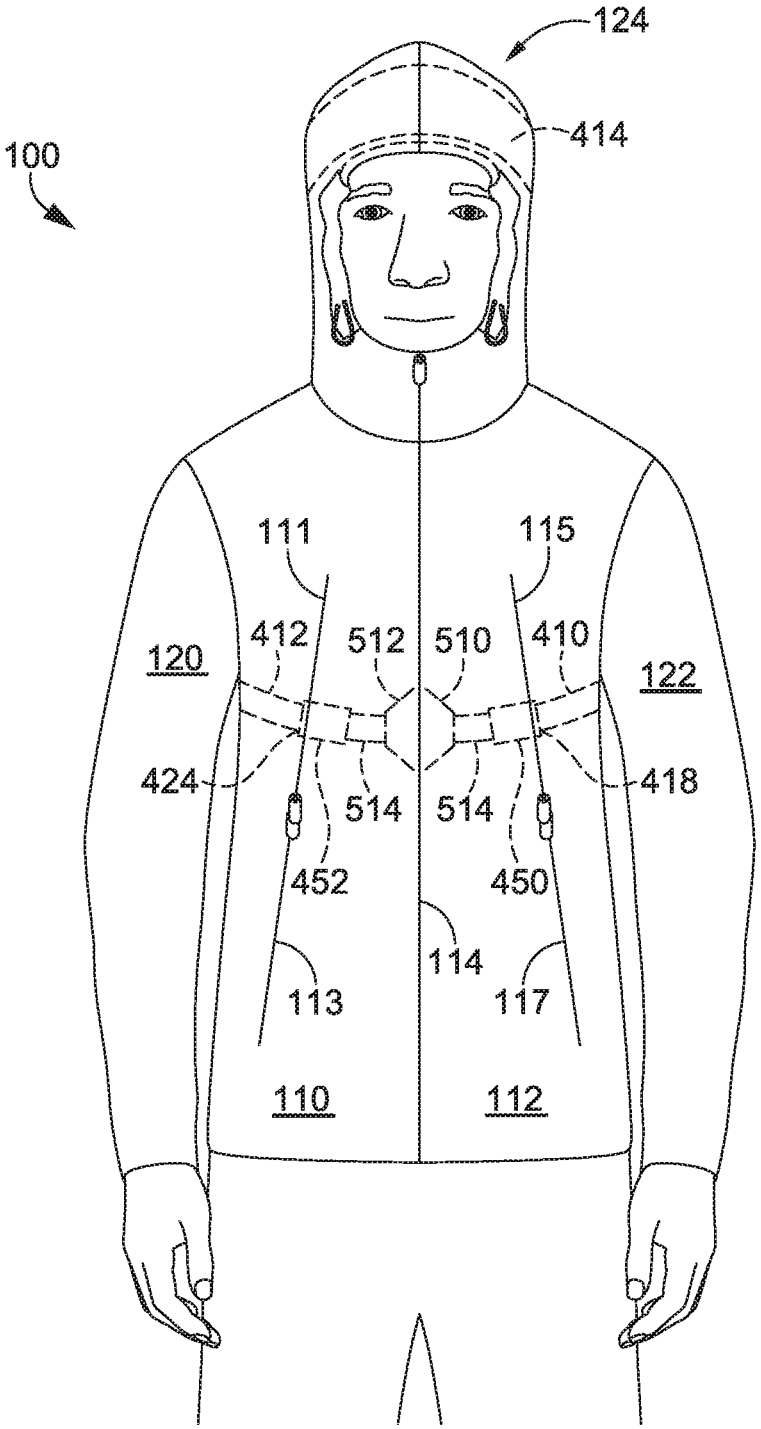
FIG. 5 illustrates a front view of the exemplary apparel item of FIG. 1 with an exemplary strap system shown in accordance with aspects herein.
Figure 6:
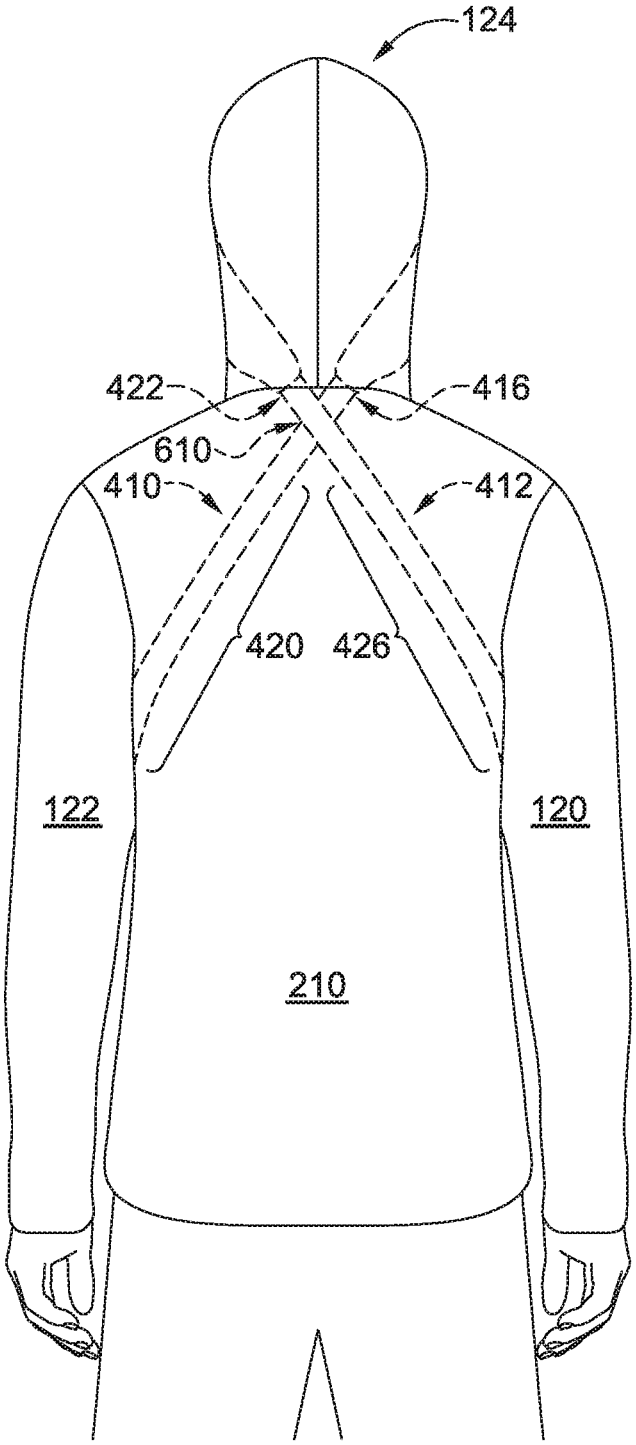
FIG. 6 illustrates a back view of the exemplary apparel item of FIG. 1 with the exemplary strap system shown in accordance with aspects herein.

Turning now to FIGS. 5 and 6, these figures depict how the strap system 400 is integrated into the apparel item 100 in accordance with aspects herein. FIG. 5 depicts a front view of the apparel item 100, and FIG. 6 depicts a back view of the apparel item 100 in accordance with aspects herein. As described above, the strap system 400 is located between inner and outer layers of the apparel item 100 such that it is hidden from view from both an exterior aspect of the apparel item 100 and an interior aspect of the apparel item 100. As such, the strap system 400 is shown as dashed lines in FIGS. 5 and 6 to indicate this aspect. Moreover, the strap system 400 is shown with the covering 460 depicted in FIG. 4B.

Referring collectively to both FIGS. 5 and 6, the third strap segment 414 is positioned within the hood 124 such that is overlays an upper forehead area of a wearer when the apparel item 100 is in an as-worn configuration. More particularly, the third strap segment 414 is positioned within the hood 124 such that it is centered on the forehead area of the wearer when the hood 124 is in an upright position. With respect to FIG. 6, the intervening portion 420 of the first strap segment 410 travels diagonally across the back panel 210 from a right side of the apparel item 100 to a left side of the apparel item 100. Similarly, the intervening portion 426 of the second strap segment 412 travels diagonally across the back panel 210 from a left side of the apparel item 100 to a right side of the apparel item 100. Reference numeral 610 indicates the intersection area where the first strap segment 410 crosses the second strap segment 412. In exemplary aspects, the intersection area 610 may be located at an upper back area of the apparel item 100 adjacent to, for instance, the neckline area 116. It is contemplated herein, however, that the intersection area 610 may be positioned more superiorly or more inferiorly on the back panel 210. By positioning the first and second strap segments 410 and 412 so they travel in opposite directions across the back panel 210, the third strap segment 414 is effectively "wrapped around" the head of the wearer as shown in FIG. 6.

With respect to FIG. 5, the first strap segment 410 continues around the left side of the apparel item 100 below the inferior margin of the sleeve opening for the sleeve 122 (e.g., below the wearer's left arm when the apparel item 100 is worn), to the second front panel 112 where it terminates at the second end 418 with its associated adjustable tightening mechanism 450. And the second strap segment 412 continues around the right side of the apparel item 100 below the inferior margin of the sleeve opening for the sleeve 120 (e.g., below the wearer's right arm when the apparel item 100 is worn), to the first front panel 110 where it terminates at the second end 424 with its associated adjustable tightening mechanism 452. In exemplary aspects, the second ends 418 and 424 with their associated adjustable tightening mechanisms 450 and 452 are anchored to the zipper assembly 114 of the apparel item 100 via anchoring portions 510 and 512 respectively. In exemplary aspects, the anchoring portions 510 and 512 may comprise fabric or material portions that are permanently secured or affixed to the adjustable tightening mechanisms 450 and 452 via, for instance, a supplemental piece of webbing 514 and are permanently secured to the zipper assembly 114. By anchoring the second ends 418 and 424 with their associated adjustable tightening mechanisms 450 and 452 as described, any tension applied to the first and second strap segments 410 and 412 via the adjustable tightening mechanisms 450 and 452 is effectively transferred to the intervening portions 420 and 426 and to the third strap segment 414 where the tension acts to move the wearer's head to an upright position and to hold it in a static state.

When the apparel item 100 is in the form of, for instance, a hoodie without a zipper assembly, it is contemplated herein that the second ends 418 and 424 with their associated adjustable tightening mechanisms 450 and 452 may be anchored in different ways. For example, the adjustable tightening mechanisms 450 and 452 may be tacked or secured to the material forming the front portion of the hoodie. Or the adjustable tightening mechanisms 450 and 452 may be tacked or secured to a supplemental piece of material that, in turn, is secured to the material forming the front portion of the hoodie. Any and all aspects, and any variation thereof, are contemplated as being within the scope herein.

In exemplary aspects, the strap system 400 is unaffixed or free-floating within the space between the inner and outer layers of the apparel item 100 with the exception of the adjustable tightening mechanisms 450 and 452 being anchored to the zipper assembly 114 as described above. Thus, any tension applied to the first and second strap segments 410 and 412 is transferred to the third strap segment 414 instead of to attachment or tack points.

As shown in FIG. 7A, which depicts a front view of the apparel item 100 in accordance with aspects herein, the adjustable tightening mechanism 450 may be positioned within the first left side pocket 115, and the adjustable tightening mechanism 452 may be located in the first right side pocket 111 to allow easy access by the wearer. The first right side pocket 111 and the first left side pocket 115 are positioned on the front of the apparel item 100 such that they are generally horizontally aligned with an inferior margin of the sleeve openings for the sleeves 120 and 122. By positioning the first right side pocket 111 and the first left side pocket 115 as described, the adjustable tightening mechanisms 450 and 452 are positioned at an upper chest area of the apparel item 100. This positioning, as opposed to locating the pockets 111 and 115 more inferiorly on the apparel item 100, helps to prevent the first and second strap segments 410 and 412 from "riding up" or moving in a superior direction after the strap segments 410 and 412 cross in the back and extend around to the front of the apparel item 100 where they are anchored. This benefits the wearer by improving wearer comfort and it also provides a better visual aesthetic as the apparel item 100 is less likely to bunch up due to the first and second strap segments 410 and 412 "riding up."

FIG. 7B provides a close-up, cut-away view of the first right side pocket 111 in accordance with aspects herein. The description of the first right side pocket 111 is equally applicable to the first left side pocket 115. The first right side pocket 111 opens into the space or void created between the outer layer (indicated by reference numeral 714) and the inner layer (indicated by reference numeral 716) of the apparel item 100. As shown, the second strap segment 412 extends around the right side of the first front panel 110 between the outer and inner layers 714 and 716 where it is threaded through the adjustable tightening mechanism 452. The adjustable tightening mechanism 452 is affixed to the zipper assembly 114 via the anchoring portion 512. For instance, the adjustable tightening mechanism 452 may be permanently secured to a first edge 700 of the anchoring portion 512 via the supplemental piece of webbing 514, and a second edge 710 of the anchoring portion 512 may be permanently secured to the zipper assembly 114 (via, for instance, securing the second edge 710 to the zipper tape).

Figure 8A:
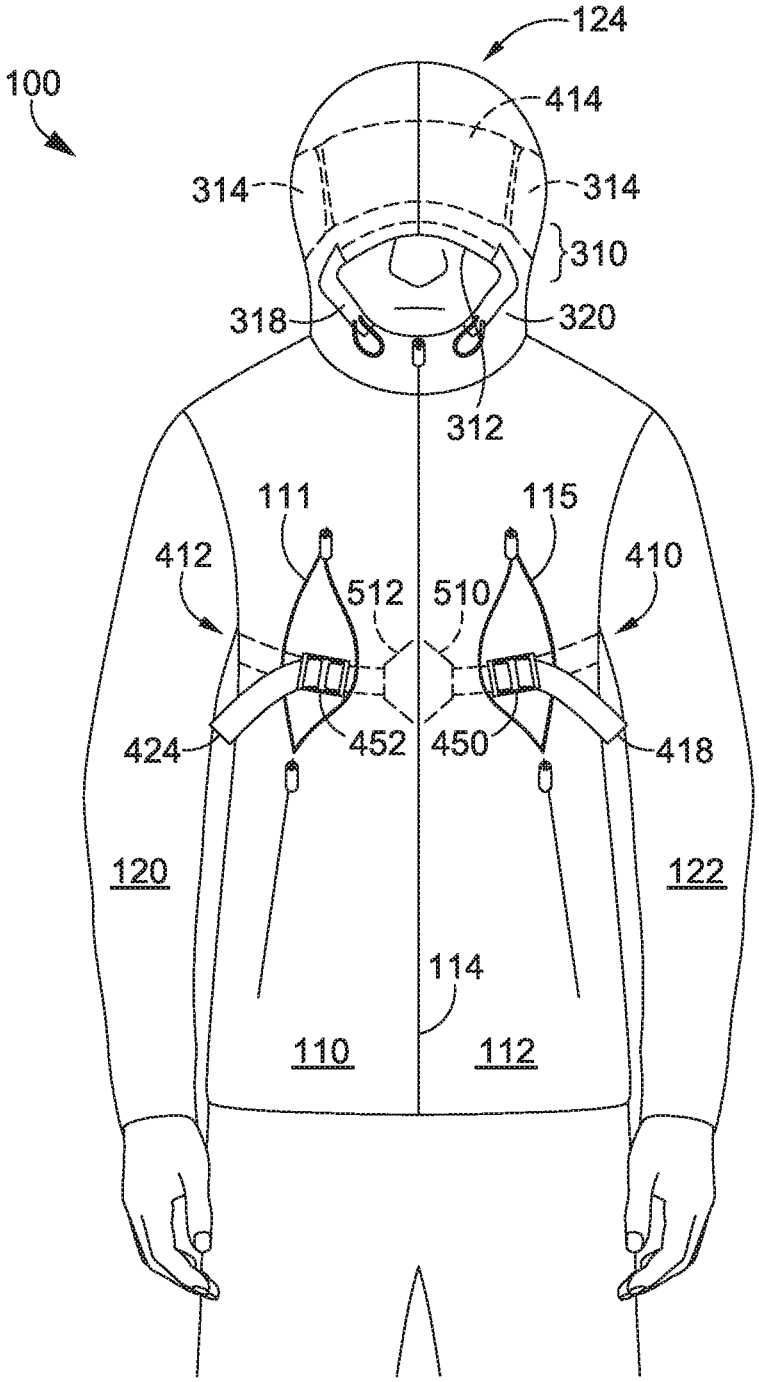
FIG. 8A illustrates a first view of a wearer wearing the exemplary apparel item of FIG. 1 with the strap system in a slack state in accordance with aspects herein.
Figure 8B:
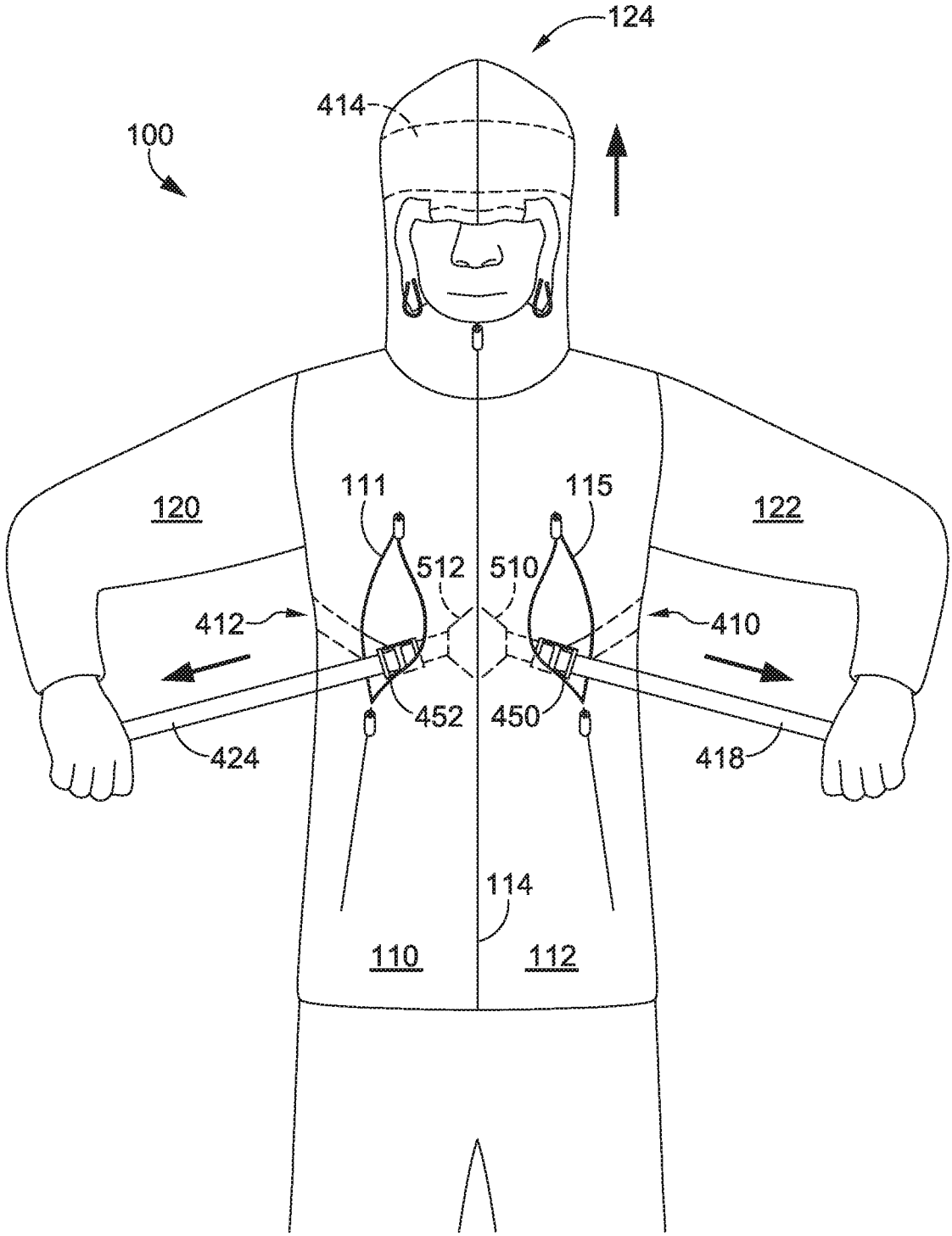
FIG. 8B illustrates a second view of the wearer of FIG. 8A with the strap system in a tensioned state in accordance with aspects herein.

FIGS. 8A and 8B illustrate how a wearer may use the apparel item 100 to reduce distractions and promote upright sleeping. With respect to FIG. 8A, FIG. 8A depicts a wearer wearing the apparel item 100. The wearer has secured the first front panel 110 to the second front panel 112 using the zipper assembly 114. As well, the wearer has positioned the eye mask 310 of the hood 124 over the wearer's eyes and has utilized the moldable strip 312 to mold the lower, free edge of the eye mask 310 over the bridge of the wearer's nose and under the wearer's eyes. Moreover, the wearer may use the adjustable tightening mechanisms 318 and 320 to further snug the hood 124 around the wearer's head and face. Configuring the hood 124 as described also helps to secure the foam inserts 314 over the wearer's ears.

Continuing with respect to FIG. 8A, the wearer may access the first right side pocket 111 and/or the first left side pocket 115 by, for instance, unzipping the pockets 111 and 115. Once unzipped, the adjustable tightening mechanisms 450 and 452 are exposed. As shown by the arrows in FIG. 8B, the wearer can exert, for instance, an outward and backward tension on the second end 418 of the first strap segment 410 and also on the second end 424 of the second strap segment 412 to help draw or thread the strap segments 410 and 412 through the adjustable tightening mechanisms 450 and 452. This tension is transmitted through the first and second strap segments 410 and 412 to the third strap segment 414. Because the third strap segment 414 is positioned around the wearer's forehead, the transmitted tension helps to pull the wearer's head to a more upright position as shown by the upward-facing arrow in FIG. 8B. The direction of the tensioning force shown in FIG. 8B is exemplary only. For instance, depending on the type of adjustable tightening mechanism used, tension may be applied in a generally downward or inferior direction, an upward or superior direction, a lateral direction, and/or a medial direction. Any and all aspects, and any variation thereof, are contemplated as being within the scope herein.

Once an adequate amount of tension has been applied to the second ends 418 and 424 of the first and second strap segments 410 and 412 to pull the head to a more upright position, the second ends 418 and 424 may be stowed in the space or void within the first pockets 111 and 115, and the first pockets 111 and 115 may be closed using, for instance, a zipper.

In exemplary aspects, the transmission of the applied tension through the first and second strap segments 410 and 412 to the third strap segment 414 is dependent upon the first and second front panels 110 and 112 being secured together via the zipper assembly 114 along all or substantially all of the length of the first and second front panels 110 and 112. This is because the anchoring portions 510 and 512 are secured to the zipper assembly 114 and thus are only effective to anchor the first and second strap segments 410 and 412 when the zipper assembly 114 is held in a fixed position subsequent to the wearer securing the first and second front panels 110 and 112 together.

The adjustable tightening mechanisms 450 and 452 help to maintain any tension applied to the second ends 418 and 424 of the first and second strap segments 410 and 412 (via, for instance, friction). In other words, the adjustable tightening mechanisms 450 and 452 maintain the first and second strap segments 410 and 412 at a fixed length after tension has been applied to the second ends 418 and 424. Thus, the wearer's head is maintained in a relatively static position until the tension is released. By holding the wearer's head in a static position, inadvertent head bobbing and uncomfortable head and neck positions are reduced, thereby improving wearer comfort and facilitating upright sleeping.

Figure 9:
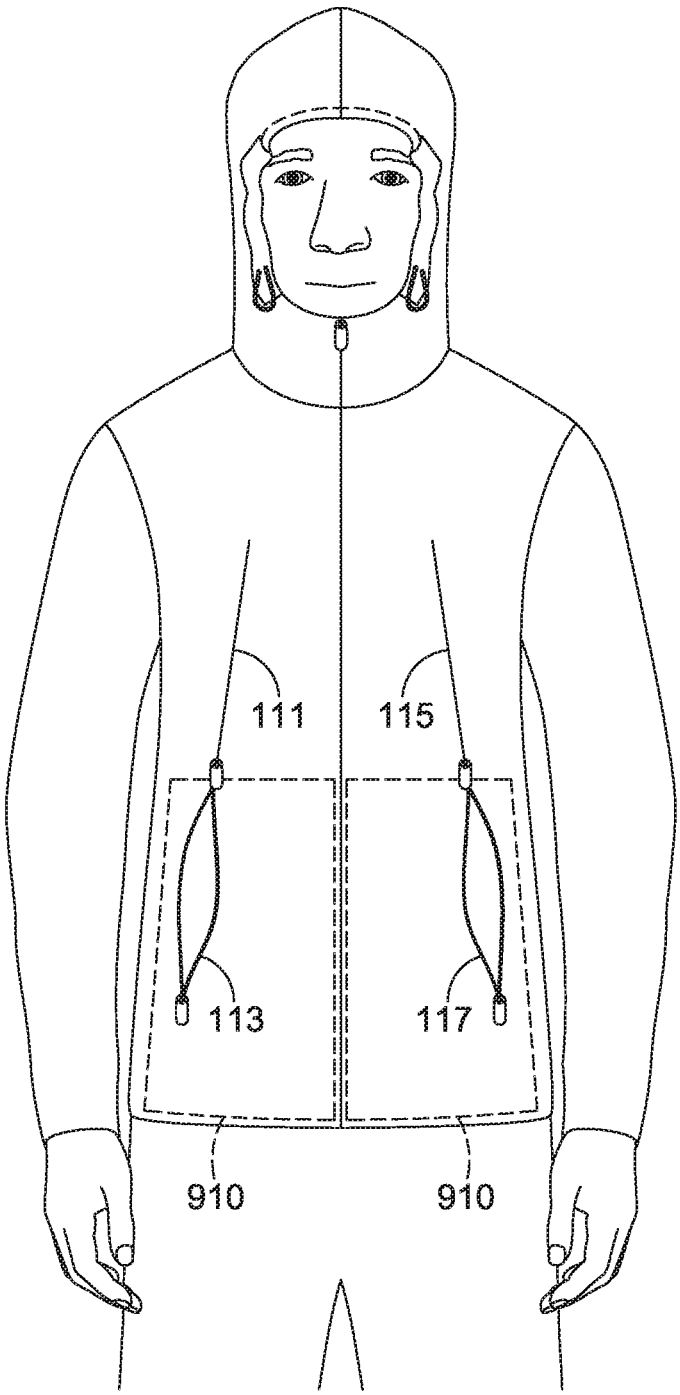
FIG. 9 illustrates an alternative aspect for the exemplary apparel item of FIG. 1 in accordance with aspects herein.

FIG. 9 depicts an alternative configuration for the apparel item 100 in accordance with aspects herein. Besides the first right side pocket 111 and the first left side pocket 115 that have been described herein, the apparel item 100 may further comprise an optional second right side pocket 113 and an optional second left side pocket 117. The pockets 113 and 117 may comprise an interior liner pouch 910 positioned between the inner and outer layers of the apparel item 100, and thus the pockets 113 and 117 may function to store objects and the like within the liner pouch 910. In other words, instead of opening into the space or void between the outer layer and the inner layer of the apparel item like the pockets 111 and 115, the pockets 113 and 115 may instead open into the liner pouch 910 making these pockets suitable for stowing items and easily retrieving those items.

Figure 10:
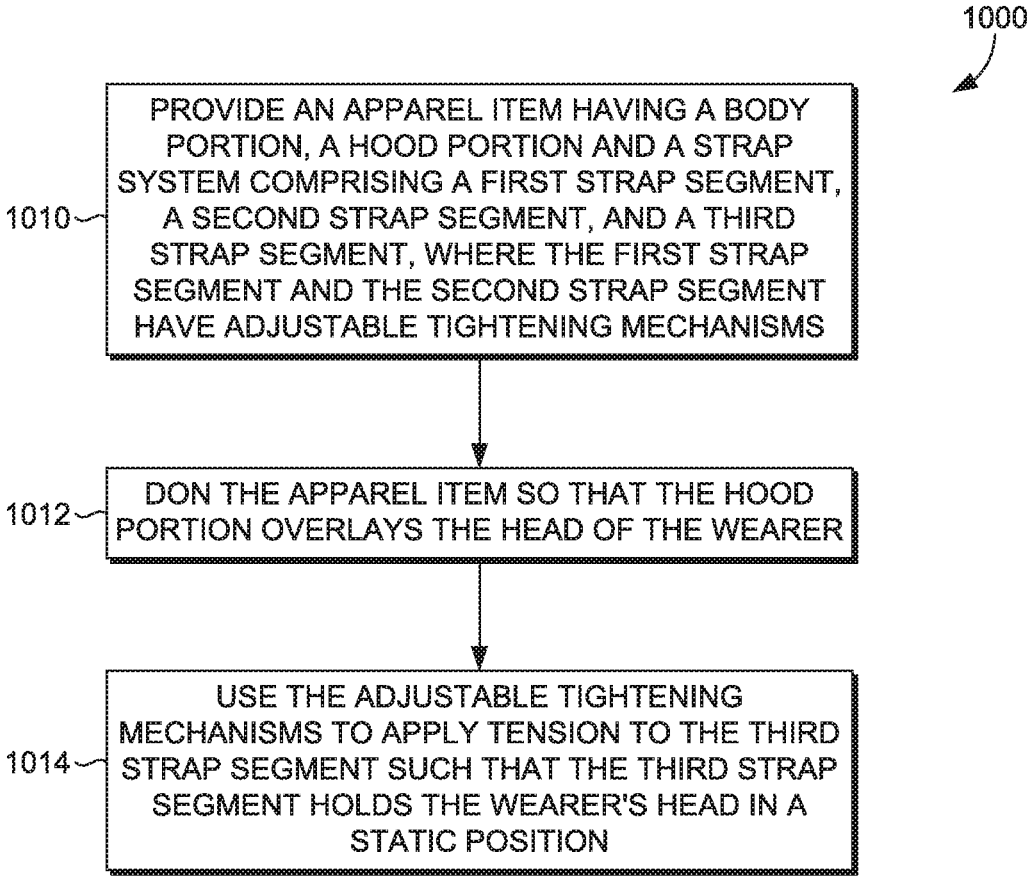
FIG. 10 illustrates a flow diagram of an exemplary method of using an exemplary apparel item configured to reduce distractions and promote upright sleeping in accordance with aspect herein.

Turning now to FIG. 10, a flow diagram of an exemplary method 1000 of using an apparel item, such as the apparel item 100 is illustrated in accordance with aspects herein. At a step 1010, the apparel item is provided. The apparel item may comprise at least, for instance, a body portion, a hood portion, and a strap system. In exemplary aspects, the apparel item may be in the form of a jacket where the body portion of the jacket comprises a first front panel and a second front panel releasably affixed together using a zipper assembly. The body portion may further comprise a back panel that together with the at least the front panels define a neckline opening, right and left sleeve openings, and a waist opening.

The strap system, in exemplary aspects, may comprise a first strap segment having a first end located at a right side of the hood portion, a second end located at a front left side of the body portion, and an intervening portion extending across the posterior face of the body portion between the first and second ends. The strap system may further comprise a second strap segment having a first end located at a left side of the hood portion, a second end located at a front right side of the body portion, and an intervening portion extending across the posterior face of the body portion between the first and second ends. The second ends of both the first and second strap segments may each comprise adjustable tightening mechanisms that are anchored to the zipper assembly via anchoring portions. The strap system may further comprise a third strap segment having a first end coupled to the first end of the first strap segment, a second end coupled to the first end of the second strap segment, and an intervening portion that extends between the first and second ends.

At a step 1012, a wearer may don the apparel item. Donning the apparel item may comprise using the zipper assembly to releasably secure the first and second front panels together along all or substantially all of their length. Donning may also comprise pulling the hood portion to an upright position such that it overlays the head of the wearer and the third strap segment is positioned so that it overlays the upper forehead area of the wearer.

At a step 1014, the wearer may use the adjustable tightening mechanisms to apply tension to the first and second strap segments and, in turn, to the third strap segment.

Because of the configuration of the first and second strap segments and because the third strap segment overlays the upper forehead area of the wearer, this tension helps to draw the wearer's head to an upright position and to maintain the wearer's head in this position until the tension is released.

The method 1000 may further comprise additional steps such as positioning the superior margin of the hood portion over the wearer's eyes so as to block ambient light. Moreover, the hood portion may comprise foam inserts located at right and left side locations of the hood portion. The method 1000 may comprise positioning the hood portion such that the foam inserts overlay the ears of the wearer where they may help to reduce of block environmental noise.

Aspects of the present invention have been described with the intent to be illustrative rather than restrictive. Alternative aspects will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

What is claimed is:

1. An apparel item configured to reduce distractions and facilitate upright sleeping, the apparel item comprising: a body portion configured to at least partially cover a front and back torso area of a wearer when the apparel item is worn, the body portion comprising at least a right side pocket and a left side pocket positioned at a front aspect of the body portion; a hood portion configured to at least partially cover a head area of the wearer when the apparel item is worn; and a strap system configured to maintain a head of the wearer in a static position, the strap system comprising: a first strap segment having a first end, a second end, and a first intervening portion extending between the first end and the second end, wherein the first end is positioned at a first location on a right side of the hood portion and the second end is secured in an interior portion of the left side pocket, a second strap segment having a third end, a fourth end, and a second intervening portion extending between the third end and the fourth end, wherein the third end is positioned at a second location on a left side of the hood portion and the fourth end is secured in an interior portion of the right side pocket, and a third strap segment having a fifth end, a sixth end, and a third intervening portion extending between the fifth end and the sixth end, wherein the fifth end is coupled to the first end of the first strap segment and the sixth end is coupled to the third end of the second strap segment.

2. The apparel item of claim 1, wherein at least the body portion of the apparel item comprises an outer layer and an inner layer, and wherein a space is maintained between the outer layer and the inner layer.

3. The apparel item of claim 2, wherein the first intervening portion of the first strap segment is located at least within the space formed between the outer layer and the inner layer of the body portion.

4. The apparel item of claim 3, wherein the first intervening portion of the first strap segment extends across a posterior aspect of the body portion of the apparel item.

5. The apparel item of claim 4, wherein the second intervening portion of the second strap segment is located within the space formed between the outer layer and the inner layer of the body portion.

6. The apparel item of claim 5, wherein the second intervening portion of the second strap segment extends across the posterior aspect of the body portion of the apparel item.

7. The apparel item of claim 1, wherein the hood portion comprises a generally circumferential opening defined at least by a superior portion, a right side portion, and a left side portion.

8. The apparel item of claim 7, wherein the superior portion of the hood portion is configured to function as an eye mask when the hood portion is in an as-worn position.

9. The apparel item of claim 8, wherein at least the superior portion of the hood portion is formed from blackout fabric.

10. The apparel item of claim 1, wherein the first and second strap segments each comprise adjustable tightening mechanisms.

11. The apparel item of claim 10, wherein the adjustable tightening mechanisms are located near the second end and the fourth end of the first and second strap segments respectively.

12. The apparel item of claim 1, wherein the hood portion comprises an outer layer and an inner layer, and wherein a space is maintained between the outer layer and the inner layer.

13. The apparel item of claim 12, wherein the hood portion further comprises a first foam insert configured to at least partially cover a first ear area of the wearer when the hood portion is in an as-worn configuration, and wherein the hood portion further comprises a second foam insert configured to at least partially cover a second ear area of the wearer when the hood portion is in the as-worn configuration.

14. The apparel item of claim 13, wherein the first and second foam inserts are positioned between the outer layer and the inner layer of the hood portion.

15. The apparel item of claim 14, wherein the first and second foam inserts are formed from at least one of a closed-cell acoustic foam or a neoprene foam.

16. The apparel item of claim 14, wherein the first end of the first strap segment is coupled to the fifth end of the third strap segment via the first foam insert, and wherein the third end of the second strap segment is coupled to the sixth end of the third strap segment via the second foam insert.

17. The apparel item of claim 16, wherein the third strap segment overlays an upper forehead area of the wearer's head when the hood portion is in the as-worn configuration.

18. An apparel item configured to reduce distractions and promote upright sleeping, the apparel item comprising: a first front panel and a second front panel both configured to overlay a front upper torso area of a wearer when the apparel item is worn, wherein the first front panel is releasably secured to the second front panel by a zipper assembly, wherein the first front panel comprises at least a right side pocket and the second front panel comprises at least a left side pocket; a back panel configured to overlay a back upper torso area of the wearer when the apparel item is worn, wherein the first and second front panels and the back panel together help to define at least a neckline opening and a waist opening for the apparel item; a hood affixed at least in part to the neckline opening, the hood having at least an outer layer and an inner layer, wherein a space or void is maintained between the outer layer and the inner layer; a first foam insert secured between the outer layer and the inner layer of the hood at a first right side location of the hood; a second foam insert secured between the outer layer and the inner layer of the hood at a second left side location of the hood; and a strap system configured to hold a head of the wearer in a static position, the strap system comprising: a first strap segment having a first end coupled to the first foam insert, a second end coupled to the zipper assembly, and a first intervening portion extending between the first end and the second end, a second strap segment having a third end coupled to the second foam insert, a fourth end coupled to the zipper assembly, and a second intervening portion extending between the third end and the fourth end, and a third strap segment having a fifth end coupled to the first foam insert, a sixth end coupled to the second foam insert, and third intervening portion extending between the fifth end and the sixth end.

19. The apparel item of claim 18, wherein the first and second front panels and the back panel comprise at least an outer layer and an inner layer, wherein the outer layer is coupled to the inner layer at select locations so as to form a void or space between the outer layer and the inner layer.

20. The apparel item of claim 19, wherein at least the first intervening portion of the first strap segment and the second intervening portion of the second strap segment are located between the outer layer and the inner layer of the first and second front panels and the back panel.

21. The apparel item of claim 18, wherein the first strap segment and the second strap segment each comprise an adjustable tightening mechanism.

22. The apparel item of claim 18, wherein the first foam insert and the second foam insert are configured to overlay the wearer's ears when the apparel item is worn.

23. The apparel item of claim 18, wherein the hood forms a generally circumferential opening defined at least by a superior margin, a left side margin, and a right side margin when the hood is in an as-worn position.

24. The apparel item of claim 23, wherein the superior margin of the hood comprises a moldable strip positioned between the outer layer and the inner layer of the hood, the moldable strip useable for conforming the superior margin of the hood to a wearer's nose area when the hood is in the as-worn position.

25. The apparel item of claim 24, wherein the left side margin and the right side margin of the hood each comprise an adjustable tightening mechanism.

26. The apparel item of claim 18, wherein the third strap segment is configured to overlay an upper forehead area of the wearer when the hood is in an as-worn position.

27. A method of using an apparel item to facilitate upright sleeping, the method comprising: providing the apparel item comprising a body portion, a hood portion, and a strap system, wherein: the strap system comprises at least: 1) a first strap segment having a first end positioned at a right side of the hood portion, a second end anchored to a left front side of the body portion and having an associated first adjustable tightening mechanism, and a first intervening portion extending between the first end and the second end, 2) a second strap segment having a third end positioned at a left side of the hood portion, a fourth end anchored to a right front side of the body portion and having an associated second adjustable tightening mechanism, and a second intervening portion extending between the third end and the fourth end, and 3) a third strap segment having a fifth end coupled to the first end of the first strap segment, a sixth end coupled to the third end of the second strap segment, and a third intervening portion extending between the fifth end and the sixth end; donning the apparel item such that the body portion overlays an upper torso area of a wearer and the hood portion overlays a head area of the wearer such that the third strap segment overlays an upper forehead area of the wearer; and using at least one or more of the first adjustable tightening mechanism or the second adjustable tightening mechanism to apply tension to the third strap segment such that a head of the wearer is held in a static position.

* * * * *